US005264258A

United States Patent [19]

Cheng

[11] Patent Number: 5,264,258

[45] Date of Patent: Nov. 23, 1993

[54] FIRE-PROOF BURI FILAMENT MATERIAL AND PROCESS FOR MAKING THE SAME

[76] Inventor: Chin S. Cheng, No. 48-1, Chang Ho Rd., Erh Shui Hsiang, Chang Hwa Hsien, Taiwan

[21] Appl. No.: 942,956

[22] Filed: Sep. 10, 1992

[51] Int. Cl.[5] ..... A47G 33/06

[52] U.S. Cl. ..... 428/7; 8/490; 8/494; 8/497; 8/518; 8/611

[58] Field of Search ..... 428/7; 8/490, 494, 497, 8/518, 611

[56] References Cited

U.S. PATENT DOCUMENTS

| | | | |
|---|---|---|---|
| 1,253,035 | 1/1918 | Hoffman | 428/7 |
| 1,773,824 | 8/1930 | Scheibner | 428/7 |
| 2,149,968 | 3/1939 | Krong et al. | 428/7 |

FOREIGN PATENT DOCUMENTS 900952 7/1962 United Kingdom .

OTHER PUBLICATIONS

*Chemical Abstracts* 95(26) 221215n.

Grayson, ed., *Encyclopedia of Textiles Fibers and Non-woven Fabrics*, John Wiley and Sons, New York (1984), pp. 187, 191 and 192.

Wingate, *Fairchild's Dictionary of Textiles*, Sixth Edition (1979) pp. 90 and 91.

*Primary Examiner*—James C. Cannon

*Attorney, Agent, or Firm*—Pro-Techtor International

[57] ABSTRACT

A fire-proof buri filament material making process includes steps of obtaining buri fibers by dipping a smashed rattan buri in a salt and dilute hydrochloric acid solution, drying the buri fibers, dipping the well-dried buri fibers in a heated hydrogen peroxide dilution, boiling the buri fibers in a pigment dye, glycerin and soda water solution, dipping the colored buri fibers in a solution containing ammonium phosphate and borax at the ratio of 3:1 for 30 minutes in forming into buri filaments, drying the buri filaments and cutting them into the desired length and binding them up with iron wires in forming into bunches of buri filaments. The invention also relates to the buri filaments made according to the aforesaid process.

2 Claims, 1 Drawing Sheet

FIRE-PROOF BURI FILAMENT MATERIAL AND PROCESS FOR MAKING THE SAME

BACKGROUND OF THE INVENTION

The present invention relates to a fire-proof buri filament material made from a rattan buri. The invention also relates to a process for making such a fire-proof buri filament material.

The filament material which is used in making an artificial Christmas tree, a garland or any of a variety of artificial decorative articles, is most commonly made from PVC (polyvinyl chloride). As PVC does not descompose easily and produces poisonous gas when burned, it is not proper to use PVC for making such filament material. For environmental protection's sake, any plastic filament material shall not be used for making a decorative article.

SUMMARY OF THE INVENTION

The present invention has been accomplished under the aforesaid circumstances. It is therefore the main object of the present invention to provide a process for making a filament material which is fire-proof and does not produce any poisonous gas when burned. It is another object of the present invention to provide a fire-proof filament material which is made from rattan buri fibers and suitable for use in making a Christmas tree, a garland or any of a variety of decorative articles without causing any environmental pollution problem.

DETAILED DESCRIPTION OF THE PREFERRED EMBODIMENT

Figure 1:
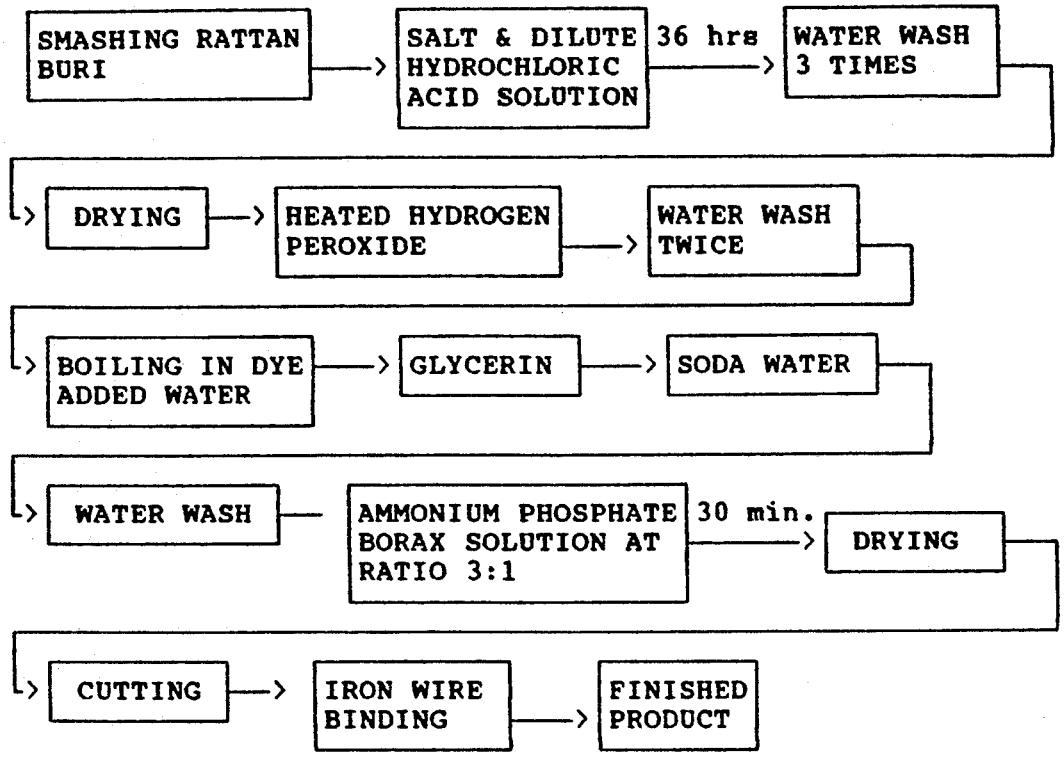
FIG. 1 is the only drawing showing a processing flow chart for making a fire-proof buri filament material according to the present invention.

Referring to FIG. 1, therein illustrated is a process for making a fire-proof buri filament material according to the present invention. The process includes steps:

1) to obtain buri fibers from a rattan buri by smashing it and dipping the buri fibers in a salt and dilute hydrochloric acid solution for 36 hours, then alternatively water-washing and drying the buri fibers three times;
2) to put the buri fibers obtained from step 1) in a heated dilute hydrogen peroxide in removing the burr then wash the buri fibers with cleaning water twice;
3) to add a pigment dye of the desired color, glycerin and soda water to a boiled water and mix it properly, then add the buri fibers thus obtained from step 2) to the boiled water for boiling for 30 minutes, and then take the colored buri fibers out of the boiled water and let them dried after a water wash wherein glycerin is to soften the buri fibers and stabilize the color, and soda water is to brighten the color and soften the colored buri fibers;
4) to dip the colored buri fibers thus obtained from step 3) in a solution containing ammonium phosphate and borax at the ratio of 3:1 for 30 minutes, then remove them from the solution and let them be dried into buri filaments;
5) to cut the buri filaments thus obtained from step 4) into the desired length and binding them up into bunches of buri filaments by iron wires.

What is claimed is:

1. A process for making a fire-proof buri filament material comprising steps: 1) obtaining buri fibers from a rattan buri by smashing it and treating the buri fibers obtained with a dilute salt-containing hydrochloric acid solution and washing and drying the treated buri fibers; 2) treating the buri fibers obtained from step 1) with hot, dilute hydrogen peroxide and washing the peroxide-treated buri fibers with water; 3) dyeing the buri fibers obtained from step 2) in a boiling aqueous solution containing a dye, glycerin and sodium bicarbonate and washing and drying the dyed fibers; 4) treating the dyed buri fibers obtained from step 3) with a solution containing ammonium phosphate and borax and drying the treated filaments; and 5) cutting the buri filaments obtained from step 4) into the desired length and binding them up into bunches of buri filaments.

2. A buri filament material made according to the process of claim 1.

* * * * *